US006782816B1

(12) United States Patent
Bolza-Schünemann

(10) Patent No.: US 6,782,816 B1
(45) Date of Patent: Aug. 31, 2004

(54) PRINTING UNIT OF A ROTARY PRINTING PRESS

(75) Inventor: Hans-Bernhard Bolza-Schünemann, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/926,145

(22) PCT Filed: Mar. 3, 2000

(86) PCT No.: PCT/DE00/00686

§ 371 (c)(1),
(2), (4) Date: Jan. 11, 2002

(87) PCT Pub. No.: WO00/54970

PCT Pub. Date: Sep. 21, 2000

(30) Foreign Application Priority Data

Mar. 12, 1999 (DE) ..... 199 11 180

(51) Int. Cl.[7] ..... B41F 7/02

(52) U.S. Cl. ..... 101/217; 101/212; 101/216; 101/349.1

(58) Field of Search ..... 107/276, 279, 107/220, 221; 101/179, 180, 152, 156, 350.6, 348, 349.1, 350.1, 352.11, 352.13, 218, 217; 492/6, 8, 18, 2, 7

(56) References Cited

U.S. PATENT DOCUMENTS

| | | | | |
|---|---|---|---|---|
| 170,542 A | * | 11/1875 | Firm | 101/220 |
| 1,733,707 A | | 10/1929 | Wood | |
| 3,049,996 A | * | 8/1962 | Downie | 101/217 |
| 5,249,522 A | * | 10/1993 | Kusch et al. | 101/248 |
| 5,558,021 A | * | 9/1996 | Erhard et al. | 101/232 |
| 5,713,286 A | * | 2/1998 | Zorn | 101/450.1 |
| 5,809,883 A | * | 9/1998 | Rodi | 101/216 |
| 6,032,579 A | | 3/2000 | Richards | |
| 6,050,185 A | | 4/2000 | Richards | |
| 6,098,540 A | * | 8/2000 | Vrotacoe et al. | 101/142 |
| 6,145,437 A | * | 11/2000 | Bock et al. | 101/349.1 |
| 6,408,747 B2 | * | 6/2002 | Koppelkamm et al. | 101/147 |

FOREIGN PATENT DOCUMENTS

| | | |
|---|---|---|
| DE | 41 36 056 A1 | 4/1993 |
| DE | 42 38 054 A1 | 5/1994 |
| DE | 44 29 891 A1 | 2/1996 |
| DE | 195 01 243 A1 | 7/1996 |
| DE | 198 15 294 A1 | 10/1998 |
| DE | WO 98/50235 | 11/1998 |
| DE | 197 57 815 C1 | 7/1999 |

* cited by examiner

*Primary Examiner*—Andrew H. Hirshfeld
*Assistant Examiner*—Leo T. Hinze
(74) *Attorney, Agent, or Firm*—Jones, Tullar & Cooper PC

(57) ABSTRACT

A printing unit for a rotary printing press utilizes form cylinders, blanket cylinders and ink cylinders and transfer rollers. Intermediate support rings are provided on these cylinders or rollers.

13 Claims, 6 Drawing Sheets

PRINTING UNIT OF A ROTARY PRINTING PRESS

FIELD OF THE INVENTION

The invention relates to a printing unit of a rotary printing press. A cylinder, roller or spindle has an outside support surface which is located between barrel ends of a barrel of the cylinder. A support device acts on this support surface.

DESCRIPTION OF THE PRIOR ART

Printing units, wherein the circumference of the form cylinder essentially corresponds to the section length of the associated folding apparatus are known for job printing, for example from DE 44 29 891 A1, as well as for newspaper printing, for example from DE 198 15 294 A1.

In connection with the printing component for job printing, it is proposed to make the diameter of the rubber blanket cylinder at least twice as large as that of the form cylinder. With the printing component for newspaper printing, the forme cylinder and the rubber blanket cylinder have the same circumference, essentially the length of one newspaper page. With both printing components for both press types, the plate cylinders can have the same length, for example 1240 mm, 1600 mm, etc. In principle it is possible with each type of printing component, i.e. also with the job printing unit, to print four newspaper pages next to each other.

U.S. Pat. No. 1,733,707 discloses a printing unit, whose forme cylinder and counter-pressure cylinder have intermediate support rings.

SUMMARY OF THE INVENTION

It is the object of the present invention to create a printing unit.

This object is attained by providing at least one forme cylinder of a rotary printing press with an outer support surface between barrel ends of its barrel. An ink roller or ink transfer roller of the printing unit also has a support surface between its ends. Support devices are arranged outside of the barrels and act on the support surfaces.

The advantages which can be achieved by the present invention reside, in particular, in that forme cylinders with a forme cylinder quotient (cylinder barrel length divided by the cylinder barrel diameter) i=3.5 and larger can be used without oscillation strips worth mentioning. It is possible to employ extremely long and slim forme cylinders. These can be equipped for receiving sleeves or printing plates.

BRIEF DESCRIPTION OF THE DRAWINGS

The present invention will be explained in what follows by means of preferred embodiments. The associated drawings show in FIG. 1, a first embodiment of a cylinder of a printing component with an intermediate support ring, FIG. 2, a schematic representation of a printing component with a further embodiment of a printing cylinder with an intermediate support ring in a view from above.

DESCRIPTION OF THE PREFERRED EMBODIMENTS

Figure 1:
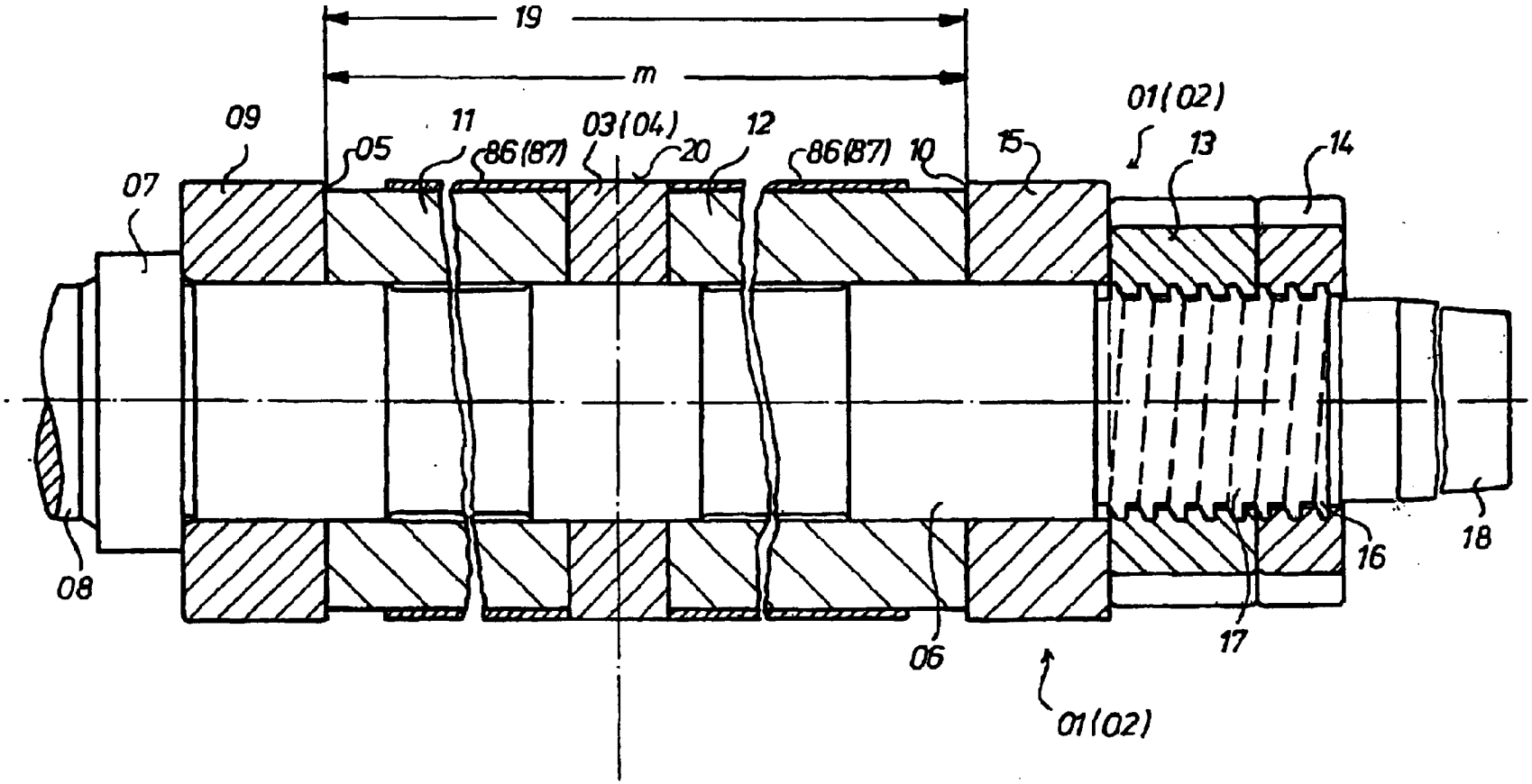

As represented in FIG. 1, the forme cylinders 01, or rubber blanket cylinders 02, in accordance with the invention have respective support devices 03, 04 within their barrel lengths m, for example centered, through which it is made possible to introduce forces, or counterforces, into them and in this way to maintain a support surface 20 of the support devices 03, or 04, in contact of a predeterminable intensity with support devices of immediately adjoining cylinders/rollers/spindles. For example, the support devices 03, 04 can be made from special steel in the form of highly accurate true-running, preferably endless support rings, so-called "Schmitz rings". The support devices 03, 04, which are advantageously provided between the left, 05, and right cylinder barrel end 10—they can be, but do not necessarily have to be in the center of the barrel, for example—will be called "intermediate support rings" for short in what follows. The support devices can also be arranged outside of the barrel center.

Figure 2:
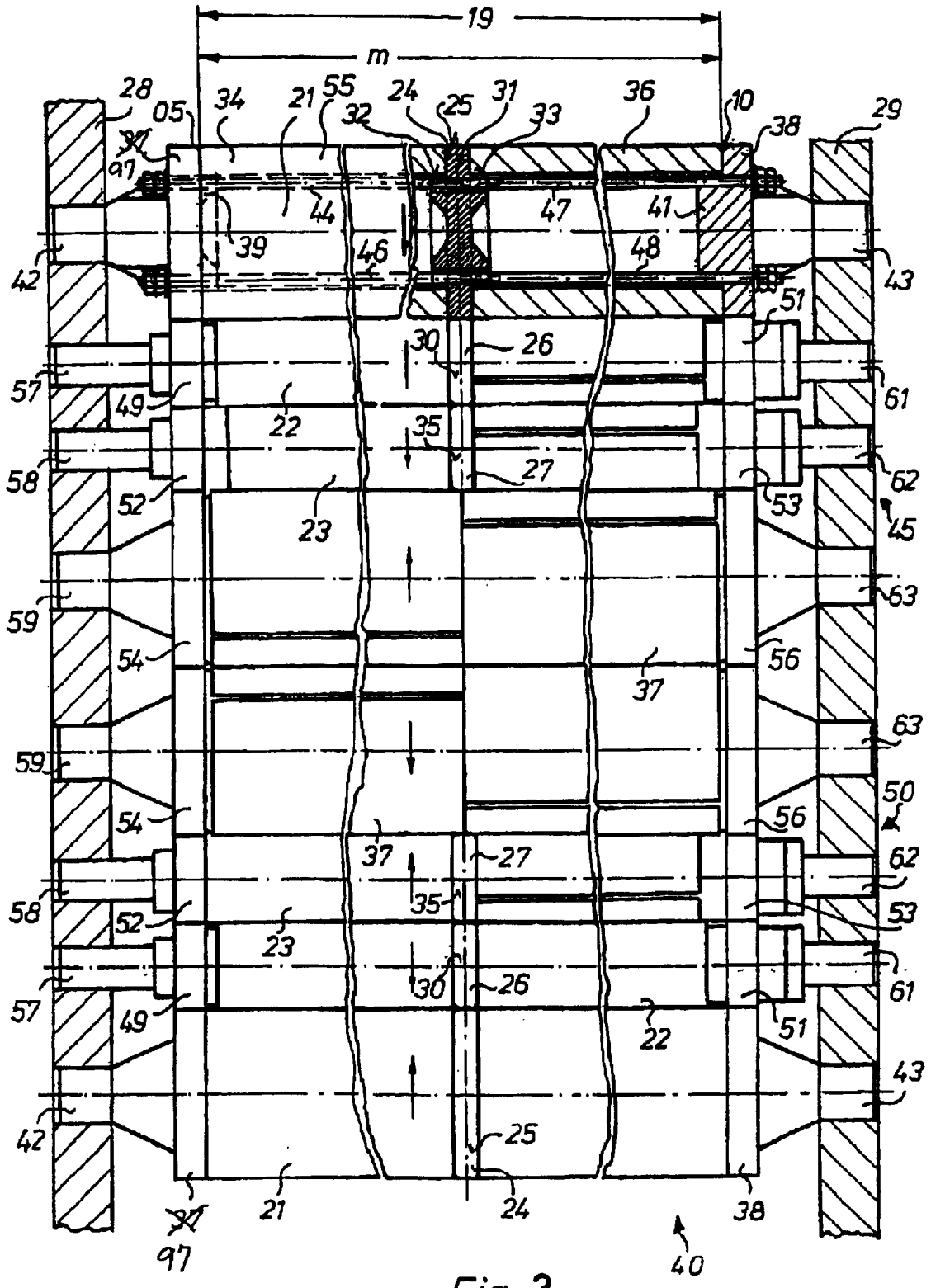

How forme cylinders, or ink transfer cylinders 01 (02) can be constructed with intermediate support rings 03 (04) is represented in FIGS. 1 and 2 by way of example.

The following have been pulled onto a continuous heavy spindle 06 (FIG. 1) with a left collar 07, which is adjoined by a left bearing journal 08, for example starting at the left collar 07 toward the right in a frictionally connected (press fit) manner and respectively resting against each other with their front:

an outer left support ring 09, a left adjusting tube 11 (a single or whole number multiple width of a newspaper page plus an allowance), an intermediate support device 03 (04) (for example intermediate support ring), a right adjusting tube 12 (a single or whole number multiple width of a newspaper page plus an allowance), and an outer right support ring 15. Following this is a clamping nut 13 and a counter-nut 14, whose interior threads are in engagement with an exterior thread 16 of a left threaded element 17. Finally, the spindle 06 terminates in a right bearing journal 18, on which a drive mechanism (motor or gear wheel) acts.

It is possible to exert pressure on the components 15, 12, 03, (04), 11 and 09, which have been threaded onto the spindle 06 with press fit, so that they are very closely pressed against each other. By means of this it is achieved that a cylinder 01, or 02, of relatively great flexural strength is created.

The two bearing journals 08, 18 are drivingly seated in associated lateral frames, not represented.

The adjusting tubes 11, 12 are equipped with plate tensioning and/or clamping devices, known per se (not represented), for example rubber blanket, clamping and/or tensioning devices. By means of these it is possible to fasten printing plates, for example offset printing plates, or rubber blankets, on the forme cylinder 01, or the ink transfer cylinder 02.

However, in the embodiment in accordance with FIG. 1 it would also be possible to pull up endless printing forme sleeves 86 and rubber blanket sleeves 87 interchangeably.

This is in particular possible in an arrangement in which only one intermediate support device 03, or 04, per cylinder 01, 02 is provided, and no outer support rings 09, 15 are provided.

Figure 3:
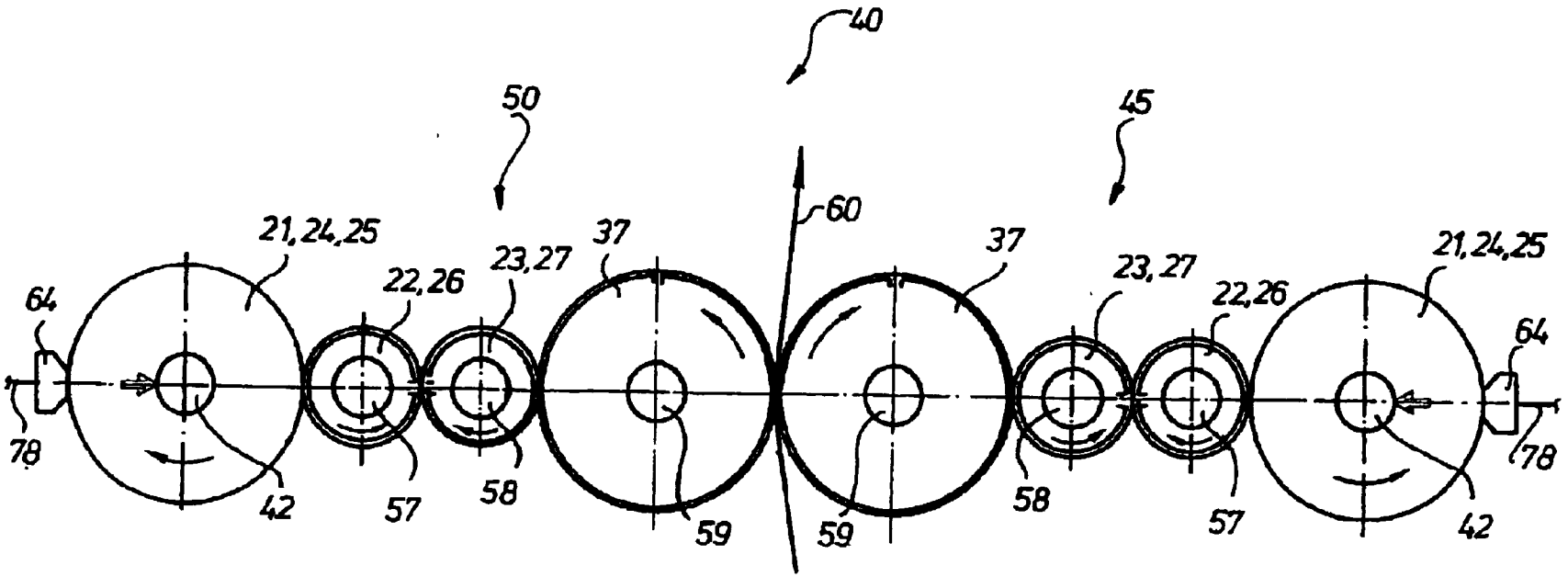
FIG. 3, the printing component of FIG. 2 without lateral frames in a front view, FIG. 4, a further embodiment of a printing component with two printing units for obverse and reverse printing with cylinders/rollers/spindles with intermediate support rings, FIG. 5, a printing component, wherein the printing units for obverse and reverse printing, respectively the axes of rotation of the cylinders/rollers/spindles for obverse printing, and those for reverse printing are each located on a plane, wherein the planes intersect at an angle, and in FIG. 6, a printing component with twice five printing units above each other, wherein the ink units for the printing units are arranged in two horizontally displaceable frames.

A further embodiment of cylinders with an intermediate support device—for example support rings—is represented in FIG. 2. A printing component 40 consists of two printing units 45, 50, i.e. in this case a first or right printing unit 45 and a second or left printing unit 50, as seen in FIG. 3. Each of the printing units 45, 50 has screen rollers 21 (=rollers of arbitrarily structured surface), ink transfer cylinders 22 and forme cylinders 23, each with an intermediate support device 24, for example an intermediate support ring 24, or 26, or 27. All of the cylinders 22, 23, or rollers 21, each have a barrel 55, which can have the same, or different barrel lengths "m". All the barrels 55 have an area 19 free from outer support rings. A barrel length m of the barrels 55 corresponds, for example, to a whole number multiple of the width of a newspaper page, plus an allowance. The screen roller 21 can have a diameter corresponding to a whole number multiple of the diameter of the forme cylinder 23, the same as the rubber blanket cylinder 37, which cooperates with the forme cylinder 23. However, it (21) can also have the same or a lesser diameter than the forme cylinder 23.

All cylinders 22, 23, 37 and the roller 21 are seated in lateral frames 28, 29 and are driven by gears or individual drive mechanisms.

The type of construction of the screen roller 21 in accordance with FIG. 2 is a further example of the cylinder 01, 02 represented in FIG. 1. All cylinders with an intermediate support ring 24, 26, 27 can be embodied in accordance with either fit structural type.

In the preferred embodiments, the intermediate support ring 24, 26, 27 is preferably made of one piece and consists of a—preferably endless—circular support ring element 31 with a left, 32, and a right cylinder-shaped shoulder 33. The shoulders 32, 33 have a width of several centimeters and have a lesser diameter than the support ring element 31. They are used for centering and as receptacles for a left, 34, or right adjusting tube 36. The first ends of these are pushed onto the shoulder 33, or 32, respectively assigned to them, of the support device 24, and are connected with them in an interlocking and frictionally connected (press fit) manner. Respective end pieces 97, or 38, are fastened to a second end of the adjusting tubes 34, 36. Each of the end pieces 97, 38 has an adjusting pin 39, or 41, and furthermore respectively one support pin 42, or 43. The support pins 42, 43 are seated in the lateral frames 28, 29 and project out of them at least on one lateral frame side. The adjusting pins 39, 41 are introduced into the interior of the adjusting tubes 34, 36 and are each connected with them by means of, for example interlocking press connections. The end pieces 97, 38 can be designed as highly accurate true-running races, or so-called endless or divided Schmitz rings (outer support rings).

For safety reasons, the end pieces 97, 38 are each connected via several screw rod connections 44, 46, or 47, 48 with the lateral faces of the shoulders 32, 33.

The running surface (support surface) 25 of the intermediate support device 24 of the screen roller 21 rolls off, for example by being pressed against it, on the running surface (support surface) 30 of the intermediate support device 26 of the ink transfer cylinder 22. The running surface (support surface) 30 of the intermediate support device 26 of the ink transfer cylinder 22 additionally rolls off on the running surface (support surface) 35 of the intermediate support device 27 of the forme cylinder 23.

The forme cylinder 23 respectively acts in a manner known per se together with the rubber blanket cylinder 37. In the preferred embodiment, the latter has no intermediate support device. However, it can have one, if a longitudinally divided paper web 60 is to be printed.

The ink transfer roller 22 can have, respectively following its two barrel ends 05, 10, a highly accurate left outer support ring 49 and a right outer support ring 51.

The ink supply roller 21, which is designed as a screen roller or structured in another way, can have, respectively following its two barrel ends 05, 10, a highly accurate left outer support ring 37 and a right outer support ring 38.

The forme cylinder 23 can have, respectively following its two barrel ends 05, 10, a highly accurate left outer support ring 52 and a right outer support ring 53.

The rubber blanket cylinder 37 can have, respectively following its two barrel ends 05, 10, a highly accurate left outer support ring 54 and a right outer support ring 56.

The support rings 97, 49, 52, 54 of the left side of the cylinder 21, 22, 23, 37, on the one hand, and on the other hand their support rings 39, 51, 53, 56 on the right side of the cylinders are each frictionally connected in series.

The left support pins or journals 42, 57, 58, 59 of the cylinders 21, 22, 23, into 37 are seated in bearings in the left lateral frame 28.

The right support pins or journals 43, 61, 62, 63 of the cylinders 21, 22, 23, 37 are seated in bearings in the right lateral frame 29.

Inking of the screen roller 21 takes place by means of a chamber doctor blade 64, known per se.

Figure 4:
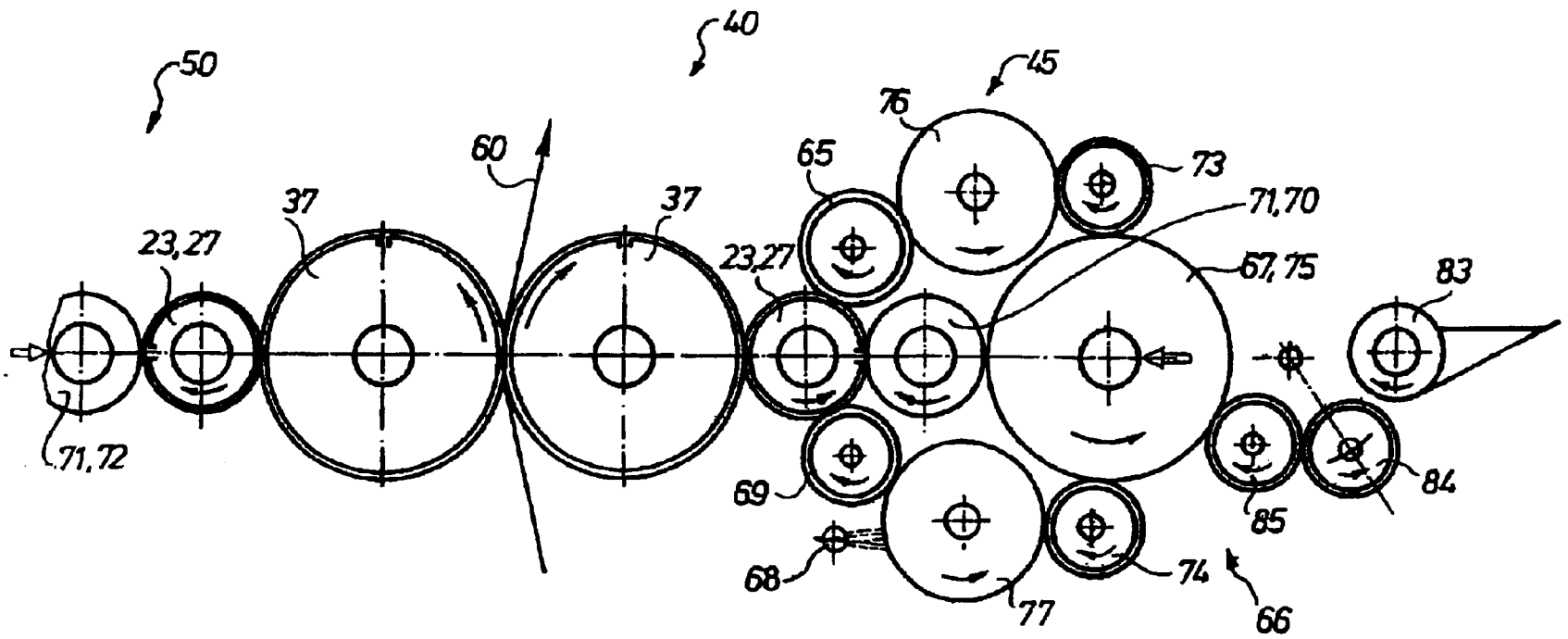

The invention is not limited to the application of ink supply devices via chamber doctor blades 64. As represented in FIG. 4, inking of the printing plates on the forme cylinder 23 can also take place by means of a conventional inking unit 66, for example a pump, siphon or film Inking unit, via two ink application rollers 65, 69, which have different diameters.

Both ink application rollers 65, 69 have one or several circular undercut(s) in the rubber-elastic coating (envelope) on their circumference. It/they lies/lie respectively opposite the intermediate support ring(s) 27 of the forme cylinder 23. By means of the undercut(s) it is achieved that the support rings 27 of the forme cylinder 23 do not run on rubber. An ink distribution roller 76, 77 with adjustable axial stroke is paired with each of the ink application rollers 65, 69. They (76, 77) have an envelope without undercuts, made of a hard oleophilic material, for example polyamide, copper, etc. They receive their ink application via respective ink transfer rollers 73, 74 without intermediate support rings, but with a rubber-elastic oleophilic coating (envelope), for example in the form of two rubber blankets arranged axially next to each other.

The rollers 73, 74 also have one or several circular undercut(s) in the rubber-elastic envelope on their circumference or—as already stated—two rubber blankets next to each other. The undercut(s) lie respectively opposite the intermediate support ring(s) 75 of the ink transfer cylinder 67. The latter can have a left and a right outer support ring. The surface of the ink transfer cylinder 67 is covered with a hard oleophilic layer (for example polyamide, copper) to the left and right of the intermediate support ring(s) 75, the same as the rollers 76, 77. In the exemplary embodiment in accordance with FIG. 4, the ink supply to the inking units for the printing units 45, 50 is provided from the ink duct 83 via a siphon roller 84 and an intermediate roller 85 to the ink transfer cylinder 67.

A support cylinder 71 (support spindle 71), which has at least one intermediate support ring 70, is provided in the space between the ink transfer cylinder 67 and the forme cylinder 23. However, it can also have two additional, i.e. located on the left or right outside, support rings, which are connected in a series frictional connection with the remaining outer support rings 37, 23, and 67.

The intermediate support ring(s) 70 is/are in rolling contact with the intermediate support ring(s) 75 of the non-screened ink transfer cylinder 67, as well as with the intermediate support ring(s) 27 of the forme cylinder 23. The oleophilic coatings of the ink application rollers 65, 69 working together with the forme cylinder 23 have—as already mentioned above—an endless undercut, the same as all rollers having an intermediate support ring. It is respectively used to provide space for the oppositely located support ring, and is respectively flush with the width of the support ring involved. The undercut is of course somewhat wider than the width of the running surface of the intermediate support ring.

All preferred embodiments so far described have in common, that all axes of rotation of the essential cylinders (37), 23, 22, 21, which are involved in printing both sides of a paper web 60, of the left and right printing units 50, 45 with and without intermediate support rings (FIG. 3), or (37), 23, 71, 67, are located parallel with each other in a common plane 78, as shown in FIG. 3. The plane 78 can extend horizontally, but also at an angle alpha in respect to the horizontal (FIG. 6).

Figure 5:
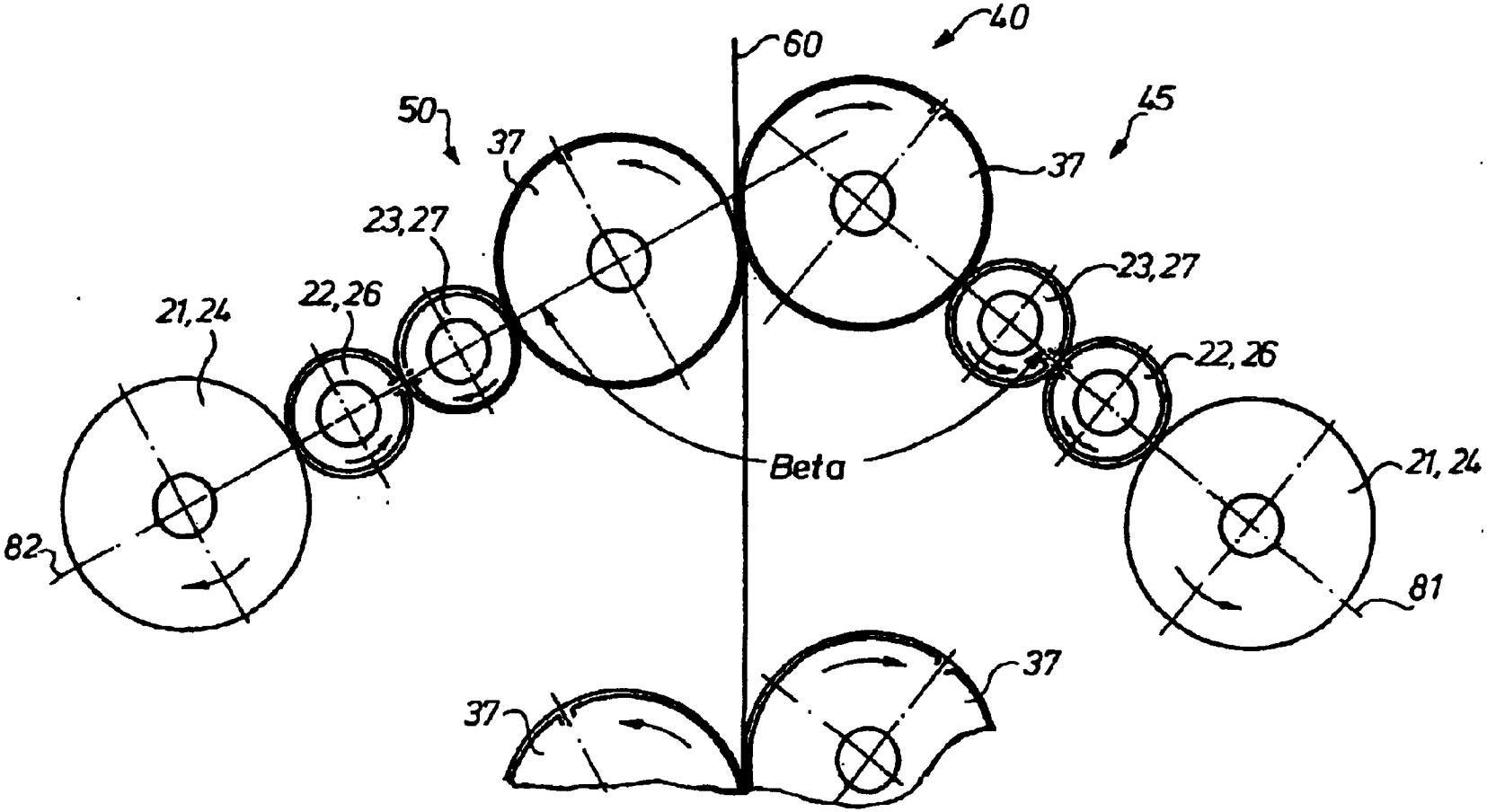

However, it is also possible that the previously mentioned essential cylinders of a first (right) printing unit 45 for printing the obverse side, and that of a second (left) printing unit 50 for printing the reverse side, are arranged in separate planes 81, 82 which extend in such a way that they intersect in an acute, right, or an obtuse, left angle beta (FIG. 5).

The diameter of the ink application roller 67 preferably is a whole number multiple of the diameter, for example twice the diameter, of the forme cylinder 23. It has at least one intermediate support ring 75 and can additionally have two outside located support rings. On it surface to the left and right of the intermediate support ring(s) it is coated with an oleophilic endless coating, for example rubber, Rilsan, copper, etc. However, it can also be covered by a rubber blanket on metal supports. It is also possible to provide sleeves with oleophilic surfaces.

Figure 6:
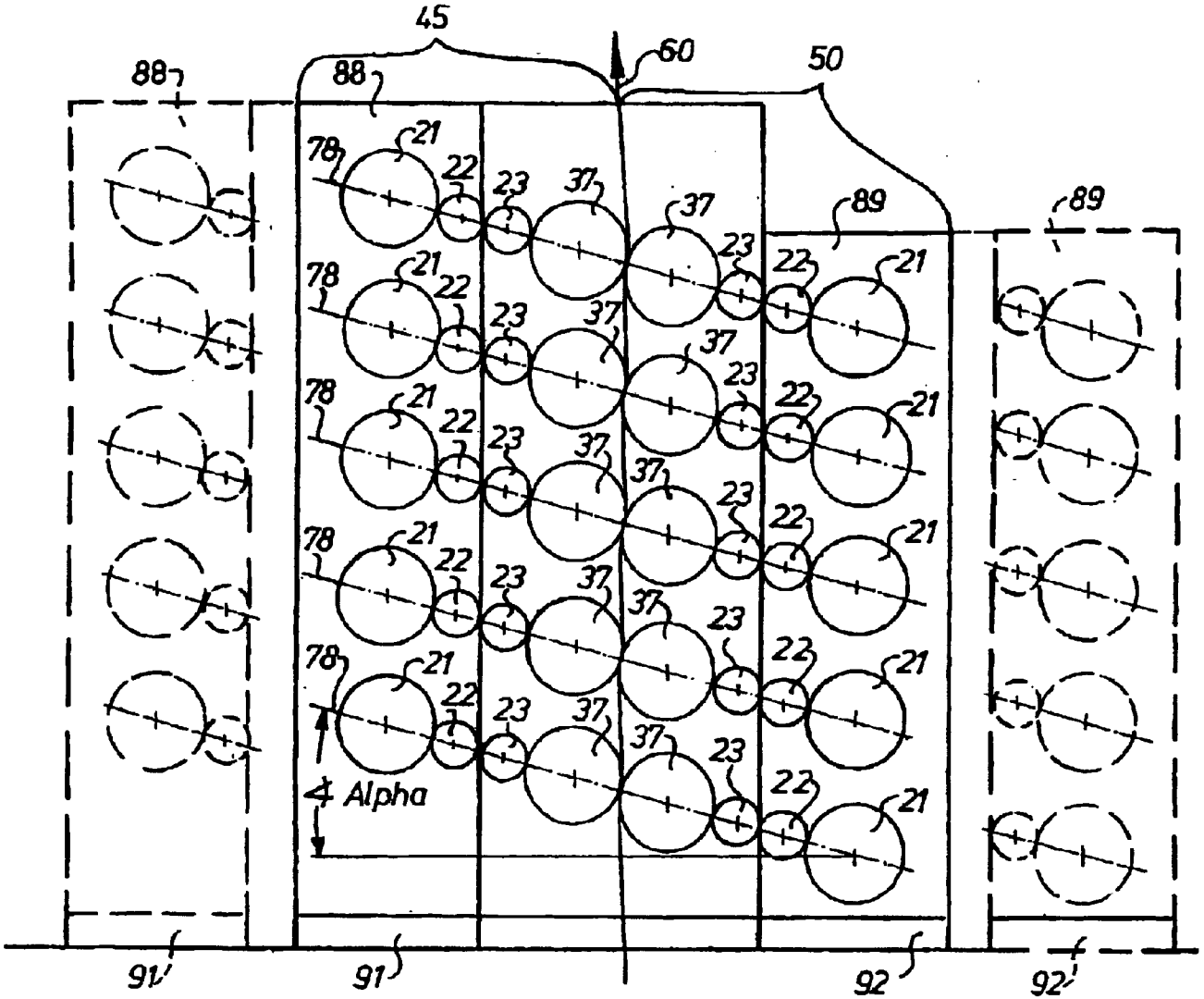

The left, 88, and right inking units 89—in the preferred embodiment shown in FIG. 6 respectively consisting of the ink transfer roller 22 and the roller 21 with a structured oleophilic surface—respectively assigned to the left and right forme cylinders 23 are respectively seated in a common, horizontally displaceable left frame 91, or driveably (for example by means of individual motors) in a right frame 92.

All essential cylinders, rollers (21, 22, 23, 37–37, 23, 22, 21) of a print location consist of two printing units 50, 45, which are located parallel with each other respectively in a common plane 78, which is inclined at an angle alpha in respect to the horizontal.

A so-called "tens tower" ("tens" printing unit) is represented in FIG. 6. The printing component 40 consists of five left printing units 45, arranged above each other, and five right printing units 50, arranged above each other. The left, 45, and right printing units 50 respectively constitute a print location for obverse and reverse printing. The respective rubber blanket cylinders 37 of each print location, which operate together, can—the same as all rubber blanket cylinders in the above described exemplary embodiments—be placed against and away from each other in a known manner (for example via driven eccentric bushings).

While preferred embodiments of a printing unit of a rotary printing press in accordance with the present invention have been set forth fully and completely hereinabove, it will be apparent to one of skill in the art that various changes could be made without departing from the true spirit and scope of the present invention which is accordingly to be limited only by the scope of the appended claims.

What is claimed is:

1. A printing unit of a rotary printing press comprising:

at least one forme cylinder;

a forme cylinder barrel, said forme cylinder barrel having spaced first and second forme cylinder barrel ends including first and second forme cylinder barrel end support surfaces;

a forme cylinder intermediate support ring with a forme cylinder intermediate support ring outer support surface, said forme cylinder intermediate support ring being positioned between said spaced first and second forme cylinder barrel ends; and an ink unit, said ink unit having at least one of an ink roller and an ink transfer cylinder, said at least one of said ink roller and said ink transfer cylinder having barrel ends, said at least one of said ink roller and said ink transfer cylinder barrel ends having barrel end support surfaces, said at least one of said ink roller and said ink transfer cylinder further having an intermediate support ring with an outer surface between said barrel ends, said intermediate support ring outer surface of said forme cylinder intermediate support ring acting against said intermediate support ring outer surface of said intermediate support ring of said at least one of said ink roller and said ink transfer cylinder and said barrel end support surfaces of said forme cylinder barrel and of said at least one of said ink roller and said ink transfer cylinder barrel acting against each other.

2. The printing unit of claim 1 wherein said inking unit includes both said ink roller and said ink transfer cylinder.

3. The printing unit of claim 1 wherein each said intermediate support rings is fixed against relative rotation with respect to its respective one of said forme cylinder barrel ends, said ink roller barrel ends and said transfer cylinder barrel ends.

4. The printing unit of claim 1 wherein said intermediate support rings are each circular support rings.

5. The printing unit of claim 1 wherein said support surfaces are level.

6. The printing unit of claim 1 further including a blanket cylinder having a plurality of axially spaced rubber blankets.

7. The printing unit of claim 1 wherein said at least one forme cylinder has a plurality of axially spaced printing plates.

8. The printing unit of claim 1 wherein each said intermediate support ring is located approximately in the center of its respective barrel.

9. The printing unit of claim 1 wherein each said support ring is a Schmitz ring.

10. The printing unit of claim 1 wherein each of said forme cylinder and said at least one of said ink roller and said ink transfer cylinder each have an axis of rotation, said axes of rotation being located on a common plane.

11. The printing unit of claim 10 wherein said at least one forme cylinder and said at least one of said ink roller and said ink transfer cylinder form a printing component.

12. The printing unit of claim 10 wherein said common plane extends horizontally.

13. The printing unit of claim 10 wherein said common plane extends at an angle with respect to a horizontal plane.

* * * * *